United States Patent [19]

Grunberg et al.

[11] Patent Number: 4,630,876

[45] Date of Patent: Dec. 23, 1986

[54] ELECTRICAL CONNECTOR

[76] Inventors: Robert M. Grunberg, 15 Fairfax Road, Bellevue Hill, N.S.W., 2023; Michael Dixon, 56 Alt Street, Bondi Junction, N.S.W., 2022, both of Australia

[21] Appl. No.: 761,851

[22] Filed: Aug. 2, 1985

[51] Int. Cl.[4] ..... H01R 13/639; H01R 13/645

[52] U.S. Cl. ..... 339/48; 339/49 B; 339/91 R; 339/186 M

[58] Field of Search ..... 339/91 R, 101, 47 R, 339/48, 49 R, 49 B, 186 R, 186 M

[56] References Cited

U.S. PATENT DOCUMENTS

| | | | |
|---|---|---|---|
| 2,521,822 | 9/1950 | Boswell | 339/49 R |
| 2,905,922 | 9/1959 | Tuchel | 339/101 |
| 3,011,143 | 11/1961 | Dean | 339/49 R |
| 3,072,340 | 1/1963 | Dean | 339/49 R |
| 4,153,326 | 5/1979 | Frantz et al. | 339/49 R |
| 4,261,628 | 4/1981 | Gallagher et al. | 339/91 R |

*Primary Examiner*—John McQuade

[57] ABSTRACT

The disclosure relates to what may aptly be termed "genderless", or "hermaphroditic", or perhaps "unisex" electrical connectors, and more particularly to such an electrical connector having a keying system which minimizes the chance of two incompatible cables being connected together.

2 Claims, 10 Drawing Figures

ELECTRICAL CONNECTOR

This invention relates to what may aptly be termed "genderless", or "hermaphroditic", or perhaps "unisex" electrical connectors, and more particularly to such an electrical connector having a keying system which minimizes the chance of two incompatible cables being connected together.

The invention is especially applicable to an electrical connection system for power transfer from an audio amplifier to one or more loudspeaker systems.

Currently, a variety of electrical connectors is being used both for low level audio signal connection applications and audio power connections, not to mention the general electrical connection field overall, and attempts to standardise such connectors have been futile up to the present owing to the fact that so many conventions exist for the same type of connector. Thus, there is extant a state of incompatibility and confusion which might well result in equipment failure due to impermissible or even catastrophic operating conditions resulting from wrong connections.

Moreover, Electrical Safety Standard I.E.C. 65 requires live contacts on electrical equipment to be shrouded in order to prevent accidents, "live contacts" being defined as those with potentials higher than 32.6 volts r.m.s. The majority of connectors used at present do not comply with this safety requirement as they were originally designed for low-level signal applications; their use as output connectors having originated a considerable number of years ago on equipment incapable of developing the outputs of from 50 and 70 volts r.m.s. that are common today.

For example, the male/female XLR-3 pin connector, for which an I.S.O. standard does exist for signal level applications, is one of the most common types of connector used for power level connection (i.e. from amplifier to speaker) and confusingly offers forty-eight possible connection configurations in the simple exercise of connecting, with correct polarity, the two output terminals of an audio power amplifier to the two input terminals of a loudspeaker system. The mere consideration that today's high-power amplifiers can deliver in excess of one Kilowatt into a load should create the necessity for a sure, safe and simple connector system and since it is necessary—as well as being sufficient—to have two conductors from an amplifier to a loud-speaker system while maintaining polarity, then a connector which will provide this unique configuration is an urgent requirement.

An electrical connector of a "unisex" kind, having two contacts and being able to be mated to another made in "its own likeness", would fulfil this requirement.

It is therefore not surprising that such unisex or genderless electrical connectors have been previously proposed! For instance, E. Diessl's U.S. Pat. No. 2,663,007 discloses an electrical plug-and-socket combination in which two contacts accommodated in a conventional kind of two-part shell are identical with two contacts accommodated within an electrical socket. Contact is made by a simple push-fit and the device appears to exhibit no further advantages but has all the drawbacks of a conventional plug and socket.

Yamada and Kawaguchi's U.S. Pat. No. 3,688,243 teaches the construction of a unisex multi-terminal connector unit. Two such units are coupled together and held in situ by self-hinged hooks which co-act with corresponding lugs or projections. This arrangement is flimsy in the extreme.

E. D. Winkler's U.S. Pat. Nos. 2,838,739; 3,091,746; 3,218,599; 3,259,870; 3,654,586 and 3,794,957 are all very similar, one to another, and disclose "genderless" electrical connectors having at least a pair of electrical contacts accommodated within a shell—in some cases a two-part shell—with each contact blade being biased by a separate leaf spring. Connection between two such connectors is simply achieved by push-fitting them together, but for disengagement, force must be exerted to remove the contact blades from their associated leaf springs. In most of the Winkler specifications, two mated connectors have to be virtually wrenched apart, with a resulting severe reduction of working life expectancy.

U.S. Pat. Nos. 367,931 (Runels); 3,192,499 (West); 3,721,939 (Paugh); 3,930,705 (Gallagher); 4,090,767 (Tregoning); 4,261,628 (Gallagher and Krolak); and 4,316,647 (Bailey and Herron) all evince those very drawbacks and shortcomings which are sought to be overcome in the present invention.

One particular drawback of all those prior-art connectors, genderless or not, is that each individual connector of a given kind may be mated up with each individual connector of its co-acting kind. As a result of this, in, say, a "multiway" loudspeaker system having several frequency range cable connections necessary, it is difficult to physically distingquish between the various connectors—and it might well be damaging, or even dangerous, to connect up non-compatible components of the system A solution that immediately springs to mind is to "color-code" the various connectors of the assortment being employed but this has its shortcomings, such as having to connect a plurality of cables in darkness or at least in dim light, and in the case where an operator suffers from color blindness.

It is therefore an object of the present invention to overcome the disadvantages of the prior art genderless or unisex devices by the provision of an electrical connector able to co-act with an identical counterpart, by virtue of its unique geometry.

Thus, according to the present invention, in a first aspect, a genderless electrical connector able to matingly co-act with an identical counterpart includes an outer shell; an insert portion surrounded by said outer shell and having inserted therein at least a pair of electrical contact strips, matable ends of which project into a chamber defined between said outer shell and said insert portion at a counterpart-seeking end thereof; a cable-receiving tail-end portion associated with said outer shell, through which tail-end portion an electrical cable may be passed for connection to the other ends of said contact strips; resilient latch means carried by said outer shell and being provided with an outwardly-directed latch hook; and a slot formed in the outer shell adjacent the lip thereof, said slot being adapted to receive therein the latch hook of a resilient latch means of a said identical counterpart when two of the electrical connectors are pushed longitudinally together into mating relationship so that at least two pairs of the contact strips are pressed together in pairs of like polarity; characterized in that at least two spline portions project inwardly from the inner wall of the outer shell and are adapted to be receivable in co-acting keyways formed in the insert portion of a said identical counterpart.

In a further aspect of the invention, a genderless electrical connector able to matingly co-act with an identical counterpart includes a diecast, zinc alloy outer shell; a polycarbonate plastic insert portion surrounded by said outer shell and molded around at least a pair of phosphor-bronze electrical contact strips, matable ends of which project into a chamber defined between the outer shell and said insert portion at a counterpart-seeking end thereof; a cable-receiving tail-end portion "snap-fitted" onto said outer shell, this tail-end portion being a substantially frusto-conical neoprene member through which an electrical cable may be passed for connection to the other ends of said at least two electrical contact strips; resilient latch means carried by the outer shell and provided with an outwardly-directed latch hook; and a slot formed in the outer shell adjacent the lip thereof, this slot being adapted to receive therein the latch hook of the resilient latch means of a said identical counterpart when two of the inventive electrical connectors are pushed longitudinally together into mating relationship so that at least two pairs of the said electrical contat strips are pressed together in pairs of like polarity; characterized in that at least two spline portions project inwardly into said chamber and are adapted to be receivable in co-acting keyways formed in a said insert portion of a said identical counterpart.

In order that the reader may gain a better understanding of the present invention, hereinafter will be described certain preferred embodiments thereof, by way of example only, and with reference to the accompanying drawings in which.

Throughout the drawings, in respect of each embodiment of the invention, similar integers are referenced by the same numeral.

Figure 1:
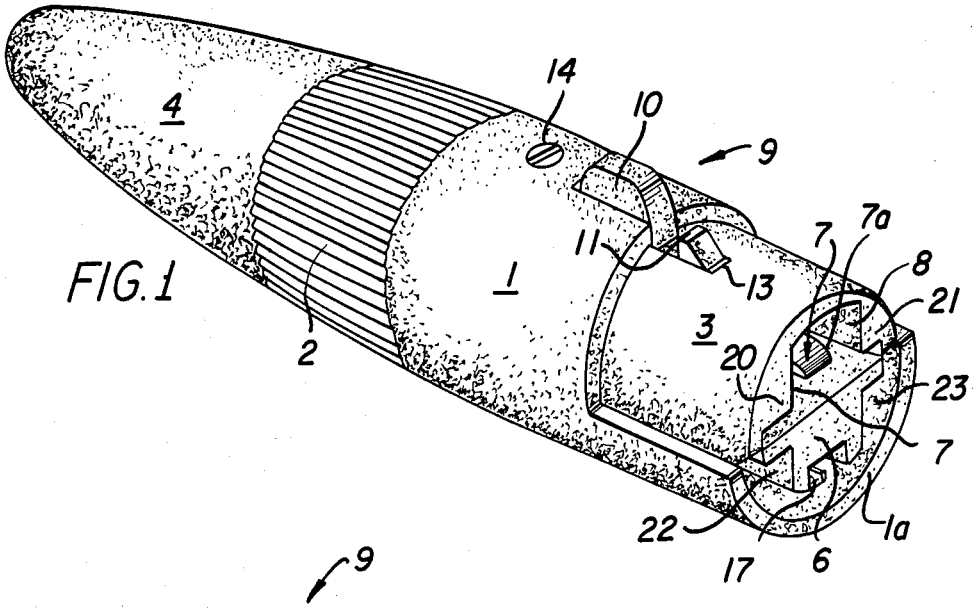
FIG. 1 is an orthogonal view of a genderless or unisex electrical connector according to the present invention.
Figure 3:
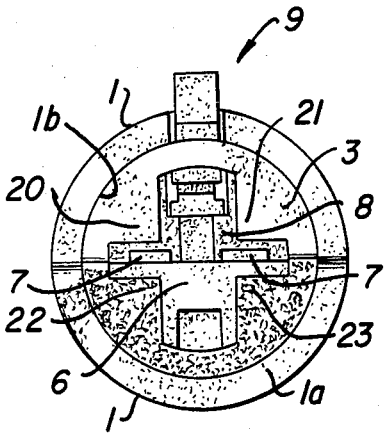
FIG. 3 is a front elevation of the connector.
Figure 2:
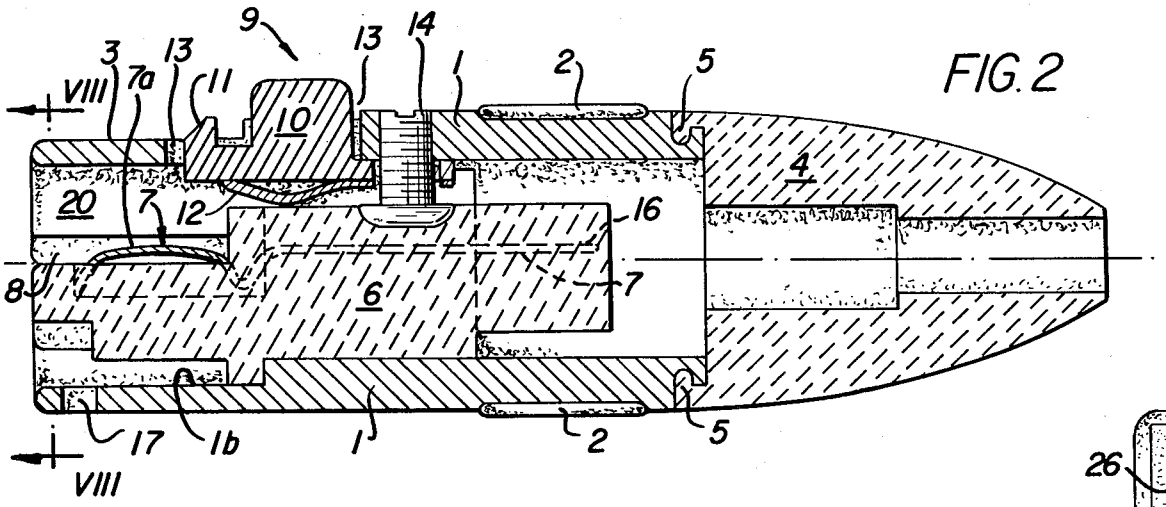
FIG. 2 is a longitudinal vertical cross-section through the connector of FIG. 1.

FIGS. 1, 2 and 3 show an electrical connector of genderless, hermaphroditic, or unisex type which includes an outer shell 1, ideally a zinc alloy die-casting, which has, about a portion of its periphery, a "tread" portion 2 to provide a user's hand with a good grip. To enable two such electrical connectors to be mated by being pushed longitudinally together, a forward portion 3 of outer shell 1 is formed so as to constitute a semi-cylindrical recess.

The outer shell further includes an inner wall 1*b* and a forward lip 1*a*.

Fitted onto the rear end of outer shell 1 is a curved-sided but substantially frusto-conical cable-receiving tail-end portion 4, advantageously made from such a material as NEOPRENE. Tail-end portion 4 snap-fits onto the tail end of outer shell 1 by virtue of an annular bead 5 which co-acts with a co-acting annular groove in outer shell 1.

Surrounded by outer shell 1 there is an insert portion 6 which may well be a molding of a suitable plastic material such as a polycarbonate. Insert portion 6 is molded around—or, at least, has inserted therein—a pair of electrical contact strips 7 which may be of beryllium-copper or chrome-steel, but, ideally, of phosphor-bronze. The matable end 7*a* of contact strips 7 which are intended to contact the corresponding strips of an identical connector project into a chamber 8 defined between forward portion 3 of outer shell 1 and insert portion 6.

The connector is provided with resilient latch means, generally referenced 9, and comprising a push-button 10, a latch hook 11 and a biassing spring 12, the button 10 and hook 11 extending up through a slot 13 in outer shell 1, latch hook 11 being outwardly directed as illustrated. Latch means 9, including spring 12 and together with insert portion 6 are firmly held in outer shell 1 by means of a set-screw or grub-screw 14. A further pair of set-screws (not shown) serve to clamp an electrical cable (also not shown) in the connector, such a cable being soldered to the opposite other or non-contact ends 16 of contact strip 7 in the usual way.

Figure 4:
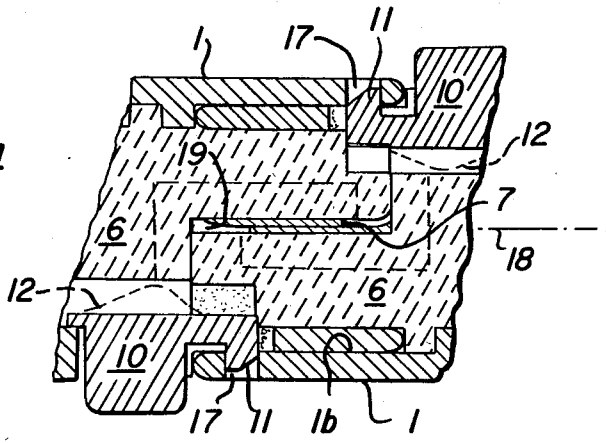
FIG. 4 shows how two identical connectors are mated, by push-fitting together.

Outer shell 1 has, adjacent its forward lip, or free edge 1*a*, a slot 17 having a closed forward end adapted to receive the latch hook of a latch means of an identical counterpart when two of the connectors are in mating relationship, as shown in FIG. 4 of the drawings. When the two identical connectors are pushed together, one being oriented at 180° to the other with respect to the combined longitudinal axes of rotation—that is to say, the "notional centre line" 18 to be seen in FIG. 4—each latch hook 11 clicks into a co-acting slot 17 and the two pairs of contact strips 7 are pressed tightly together in pairs of like polarity.

The contact strips 7 thus connect very positively without the need for extraneous leaf or other springs, and are enclosed within a very small plenum 19 (see FIG. 4) defined between insert portions 6 of the pair of connectors, effectively preventing distortion of the strips. As this plenum, or space, 19 is so very small in volume, little oxidation can occur but, in any case, as the area of contact is relatively large, self-cleaning takes place every time two connectors are engaged or disengaged. A further advantage accrues from the arrangement of opposed latches, inasmuch that it tends to minimize undesirable flexing of the mated pair; to disengage two mated connectors, their push-buttons 10 are simultaneously pressed inwardly and the connectors are just pulled easily apart.

Figure 10:
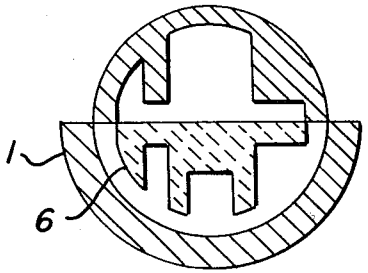
FIGS. 8, 9 and 10 are transverse cross-sections taken along line VIII—VIII of FIG. 2, illustrating three examples of varying geometries.
Figure 8:
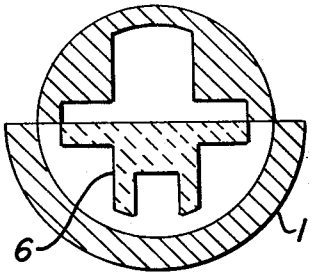
Figure 9:
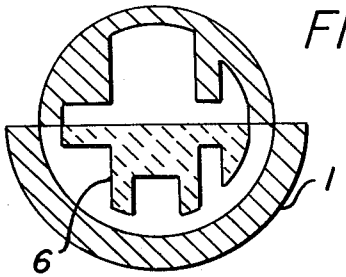

Projecting inwardly into the defined chamber 8 is a pair of what may be called lands or spline portions 20 and 21 and these are adapted—that is to say, they are so dimensioned as to be a "snug" fit—to be receivable in co-acting keyways formed in the insert portion of an identical counterpart. Such keyways are referenced 22 and 23 in FIGS. 1, 2 and 3. Thus it will be realized that such an arrangement of spline portions and co-acting keyways effectively serves to prevent inappropriate electrical connections from being made in error or ignorance when a plurality of connections is to be made. This arrangement will become even more clear when FIGS. 8, 9 and 10 are described, hereinafter.

Figure 5:
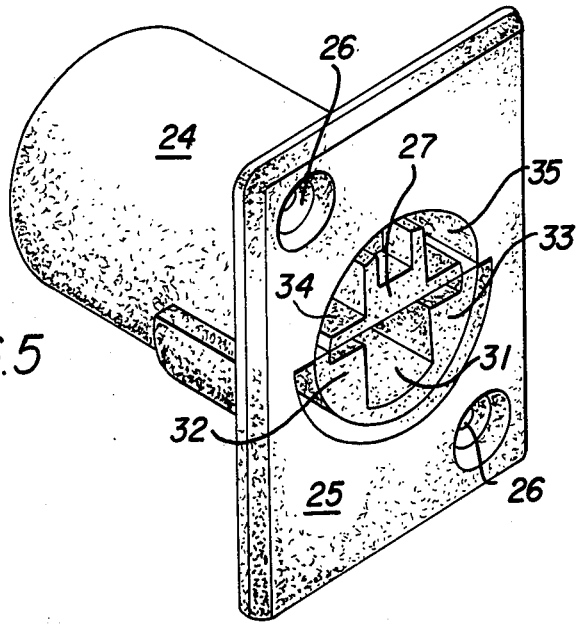
FIG. 5 is an orthogonal view of a modification of the invention, being a panel socket.
Figure 7:
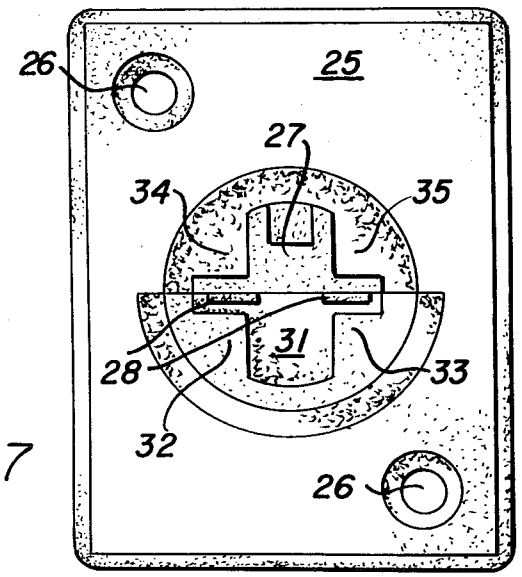
FIG. 7 is a front elevation of the panel socket.
Figure 6:
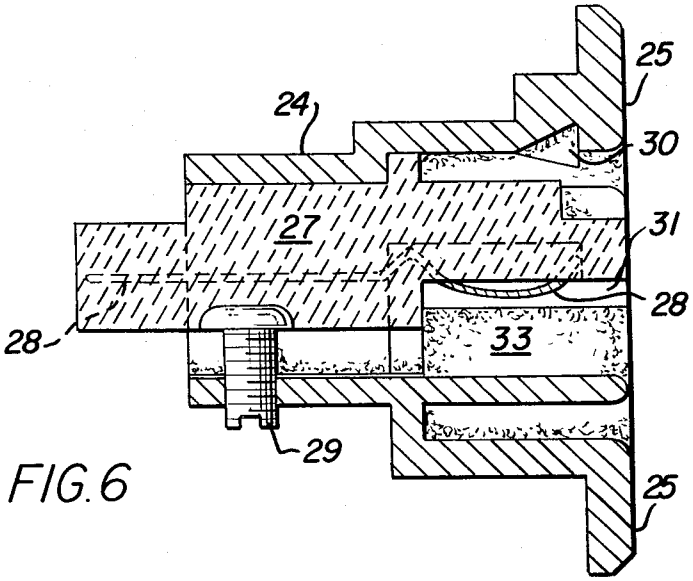
FIG. 6 is a longitudinal vertical cross-section through the panel socket of FIG. 5.

FIGS. 5, 6 and 7 represent a panel socket of a concept in tune with the invention as hereinbefore described, having an outer cylindrical shell 24 integral with an escutcheon 25, this latter being provided with countersunk screwholes 26 by means of which the socket may be affixed to a wall or panel.

Accommodated within outer shell 24 is an insert portion 27, preferable of a polycarbonate plastic, molded around a pair of electrical contact strips 28, ideally of phosphor-bronze. Insert portion 27 is secured within outer shell 24 by a grub-screw or set-screw 29 (see FIG. 6) and, here again, a recess 30 is formed in the inner face of outer shell 24, this recess 30 being adapted to receive a latch hook, such as that referenced 11 in FIGS. 1 to 4, of an inventive connector is plugged into the panel socket. When such an inventive electrical connector is connected to a socket instead of to an identical counterpart, flexing is not a serious consideration.

Projecting inwardly into the chamber 31 which is defined between outer shell 24 and the insert portion 27 is a pair of spline portions 32 and 33, and flanking the insert portion 27 are keyways 34 and 35, as previously described.

From a perusal of the drawings and the descriptions of them, it will realized that the electrical contact strips are located in such a way as to be shrouded from finger contact, as specified in Electrical Safety Standard I.E.C. 65, thus ensuring safe operation at high voltages because the defined chambers—reduced in volume as they are by the projecting spline portions—are of a size insufficient to admit a human finger-tip. In this regard it may be noted that the accompanying drawings are to a scale of 5:2. The relatively large contact surface will enable high currents to be safely conducted.

To fulfil that object of the invention, namely, to provide a keying system safe for use with such as a "multi-way" loudspeaker array necessitating several frequency range cable connections, various geometries of spline portion/keyway sets are contemplated and three of these are illustrated in FIGS. 8, 9 and 10. As will be clearly seen, none of these three configurations is interconnectable one with the other, and various other spline/keyway combinations can be envisaged.

Notwithstanding that the foregoing description is couched in terms of a genderless or unisex electrical connector having a pair of contact strips, such as those referenced 7 and 28 in FIGS. 1 to 4 and FIGS. 5 to 7 respectively, it is nevertheless envisaged that there could well be some other embodiments comprising what may be termed "ganged" contact strips. Thus the use of say, four, six, eight or even ten contact strips may be considered as being within the scope of the present invention, the non-essential differences being only in the size and geometry of the outer shell and its fitting insert portion, and in the size, shape and number of the sline-and-keyway combinations.

From the abovegoing, the reader will readily appreciate that genderless electrical connectors able to matingly co-act with identical counterparts, and being manufactured in accordance with the present invention, will provide the public with a new or much-improved article or, at the very least, offer to it a useful and most attractive choice.

What is claimed is:

1. A genderless electrical connector able to matingly co-act with an identical counterpart, said connector including an outer shell having a forward lip and inner wall; an insert portion surrounded by said outer shell and having inserted therein at least a pair of electrical contact strips having matable ends which project into a chamber defined between said outer shell and said insert portion at a counterpart-seeking end thereof; a cable-receiving tail-end portion associated with said outer shell, through which tailend portion an electrical cable may be passed, said contact strips having opposite other ends adapted for connection to the electrical cable; resilient latch means carried by said outer shell and being provided with an outwardly-directed latch hook; and a slot formed in said outer shell, said slot disposed diametrically opposite said resilient latch means and adjacent said lip of said outer shell, said slot being adapted to receive therein the latch hook of a resilient latch means of a said identical counterpart when two of said electrical connectors are pushed longitudinally together into mating relationship so that at least two pairs of said contact strips are pressed together in pairs of like polarity: characterized in that said shell includes at least two splines projecting inwardly from said inner wall, said insert portion spaced inwardly from said outer shell to provide at least two keyways, said projecting splines being so dimensioned as to fit closely into co-acting ones of said keyways formed in the insert portion of a said identical counterpart; said splines and keyways cooperating to prevent inappropriate electrical connection being made, and the said insert portion being removably secured in said outer shell.

2. A genderless electrical connector able to matingly co-act with an identical counterpart, said connector including a die-cast, zinc alloy outer shell having a forward lip and inner wall; a polycarbonate plastic insert portion surrounded by said outer shell and molded around at least a pair of phosphor-bronze electrical contact strips having matable ends which project into a chamber defined between said outer shell and said insert portion at a counterpart-seeking end thereof; a cable-receiving tail-end portion comprising a substantially frusto-conical neoprene member through which an electrical cable may be passed, said contact strips having opposite other ends adapted for connection to the electrical cable; resilient latch means carried by said outer shell and being provided with an outwardly-directed latch hook; and a slot formed in said outer shell, said slot disposed diametrically opposite said resilient latch means and adjacent said lip of said outer shell, said slot being adapted to receive therein the latch hook of a resilient latch means of a said identical counterpart when two of the said electrical connectors are pushed longitudinally together into mating relationship so that at least two pairs of said electrical contact strips are pressed together in pairs of like polarity; characterized in that said shell includes at least two splines projecting inwardly from said inner wall, said insert portion spaced inwardly from said outer shell to provide at least two keyways, said projecting splines being so dimensioned as to fit closely into co-acting ones of said keyways formed in the insert portion of a said identical counterpart; said splines and keyways cooperating to prevent inappropriate electrical connection being made; and the said insert portion being removably secured in said outer shell

* * * * *